US009531125B2

(12) United States Patent
Fan et al.

(10) Patent No.: US 9,531,125 B2
(45) Date of Patent: Dec. 27, 2016

(54) PLUG AND CONNECTOR WITH THE SAME

(71) Applicants: HONG FU JIN PRECISION INDUSTRY (WuHan) CO., LTD., Wuhan (CN); HON HAI PRECISION INDUSTRY CO., LTD., New Taipei (TW)

(72) Inventors: Yong-Chang Fan, Wuhan (CN); San-Yong Yang, Wuhan (CN)

(73) Assignees: HONG FU JIN PRECISION INDUSTRY (WuHan) CO., LTD., Wuhan (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/684,934

(22) Filed: Apr. 13, 2015

(65) Prior Publication Data

US 2016/0240971 A1 Aug. 18, 2016

(30) Foreign Application Priority Data

Feb. 12, 2015 (CN) ..... 2015 1 0073220

(51) Int. Cl.

| | |
|---|---|
| ***H01R 13/658*** | (2011.01) |
| ***H01R 13/639*** | (2006.01) |
| ***H01R 13/6581*** | (2011.01) |
| ***H01R 9/18*** | (2006.01) |
| ***H01R 4/48*** | (2006.01) |

(52) U.S. Cl.

CPC ..... *H01R 13/639* (2013.01); *H01R 4/48* (2013.01); *H01R 9/18* (2013.01); *H01R 13/6581* (2013.01)

(58) Field of Classification Search

CPC .... H01R 2201/20; H01R 24/40; H01R 13/625
USPC ..... 439/314–323, 635, 578
See application file for complete search history.

(56) References Cited

U.S. PATENT DOCUMENTS

| | | | | |
|---|---|---|---|---|
| 4,206,963 | A * | 6/1980 | English | H01R 24/42 439/578 |
| 4,504,815 | A * | 3/1985 | Harwath | H01H 85/306 337/201 |
| 4,892,491 | A * | 1/1990 | Budano, II | H01R 24/44 439/578 |
| 4,914,060 | A * | 4/1990 | Seas | H01R 13/625 439/314 |
| 5,217,391 | A * | 6/1993 | Fisher, Jr. | H01R 24/44 439/578 |
| 5,989,070 | A * | 11/1999 | Al-Turki | F21V 19/006 439/638 |
| 6,036,522 | A * | 3/2000 | Holzer | F21V 19/0005 439/306 |
| 6,203,368 | B1 * | 3/2001 | Weidner | H01R 9/0509 439/579 |
| 6,364,681 | B1 * | 4/2002 | Watanabe | H01R 13/625 439/335 |

(Continued)

*Primary Examiner* — Briggitte R Hammond
(74) *Attorney, Agent, or Firm* — Zhigang Ma

(57) ABSTRACT

A plug includes a plug main body used to engage with a socket and a securing member secured to the plug main body. The securing member includes a securing portion. When the plug is engaged with the socket, the securing member is rotatable relative to the socket to engage the securing portion with the socket. The disclosure further provides a connector with the plug.

16 Claims, 5 Drawing Sheets

(56) References Cited

U.S. PATENT DOCUMENTS

| | | | | |
|---|---|---|---|---|
| 6,568,949 | B1 * | 5/2003 | Walters | H01R 13/5202 439/319 |
| 6,602,093 | B1 * | 8/2003 | Cannon | H01R 13/625 439/578 |
| 6,808,407 | B1 * | 10/2004 | Cannon | H01R 13/625 439/314 |
| 7,081,001 | B1 * | 7/2006 | Conroy | H01R 13/625 439/314 |
| 7,632,126 | B1 * | 12/2009 | Farole | H01R 12/592 439/314 |
| 7,922,511 | B1 * | 4/2011 | Schweitzer | H01R 13/625 439/171 |
| 2011/0312199 | A1 * | 12/2011 | Alrutz | H01R 13/622 439/188 |

* cited by examiner

PLUG AND CONNECTOR WITH THE SAME

FIELD

The subject matter herein generally relates to a plug and a connector with the plug.

BACKGROUND

Connectors are widely used in electronic devices, such as computers, routers or servers to transmit power or signals between different electronic components. For different peripheral devices, the computers or servers often need different connectors, such as a Universal Serial Bus (USB) connector, or a cable connector for supplying power for a router.

BRIEF DESCRIPTION OF THE DRAWINGS

Implementations of the present technology will now be described, by way of example only, with reference to the attached figures.

DETAILED DESCRIPTION

Figure 1:
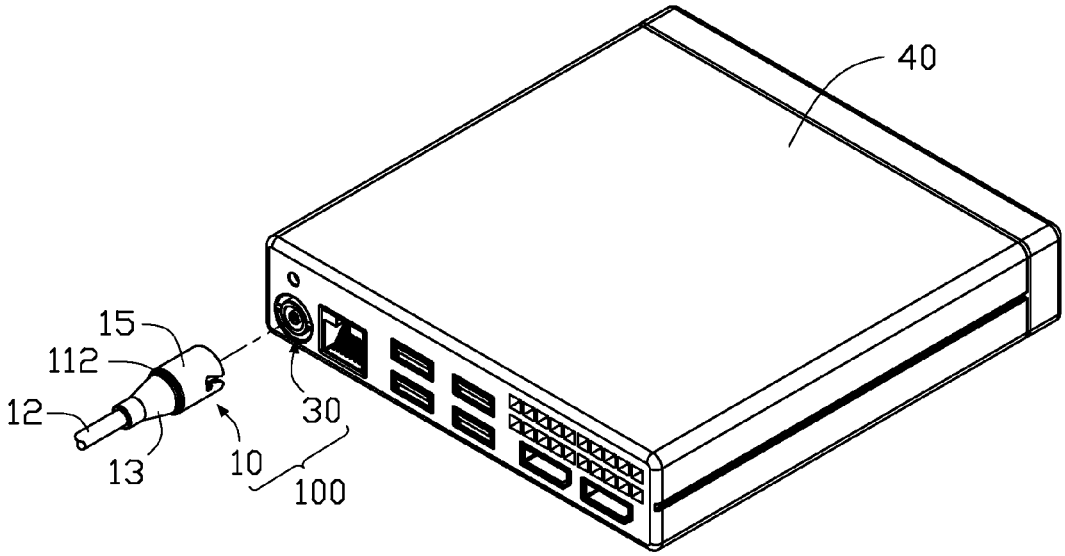
FIG. 1 is an exploded, isometric view of a connector and an electronic device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

The present disclosure is described in relation to a plug and a connector with the plug. The plug includes a plug main body used to engage with a socket and a securing member secured to the plug main body. The securing member includes a securing portion. When the plug is engaged with the socket, the securing member is rotatable relative to the socket to engage the securing portion with the socket.

FIG. 1 illustrates an embodiment of a connector 100. The electronic device 100 can include a plug 10 and a socket 30 configured to connect to the plug 10. The socket 30 can be set on an electronic device 40, such as a router. The connector 100 can be a cable connector that is configured to supply power for the router.

Figure 2:
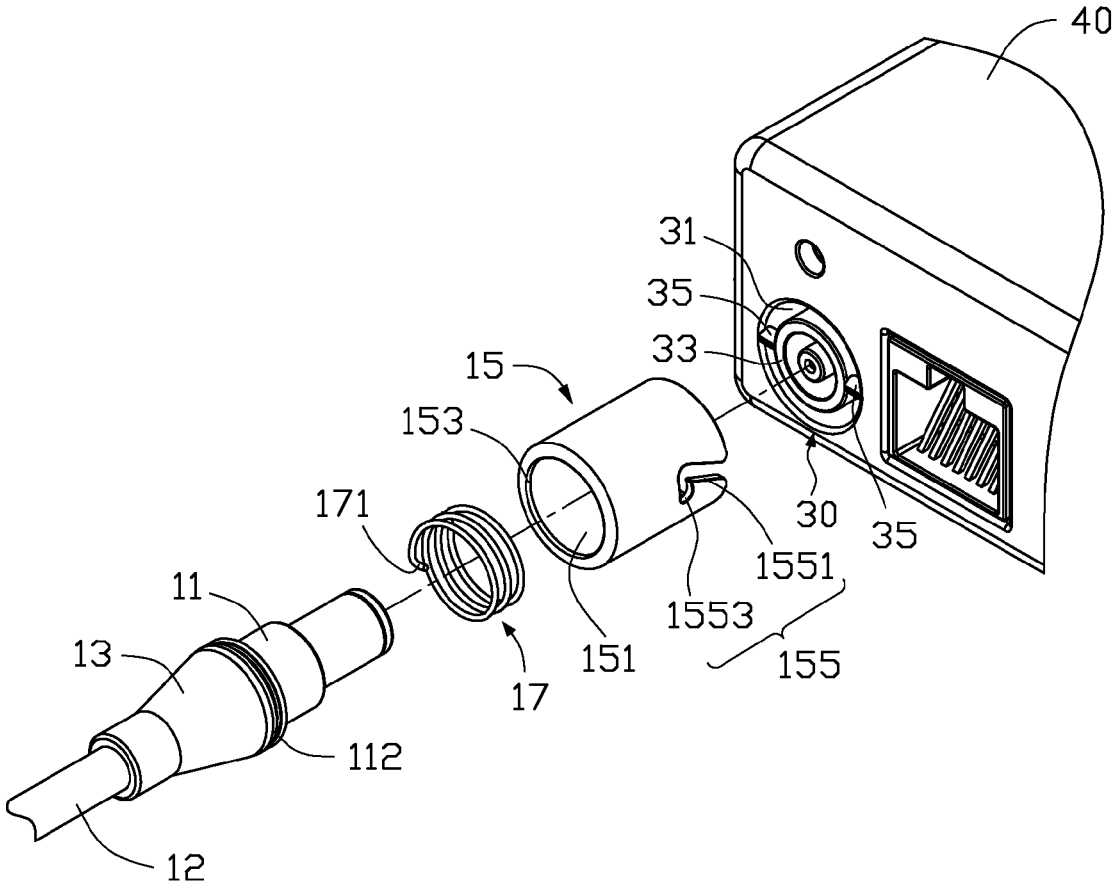
FIG. 2 is s an exploded, isometric view of the connector and the electronic device of FIG. 1.
Figure 3:
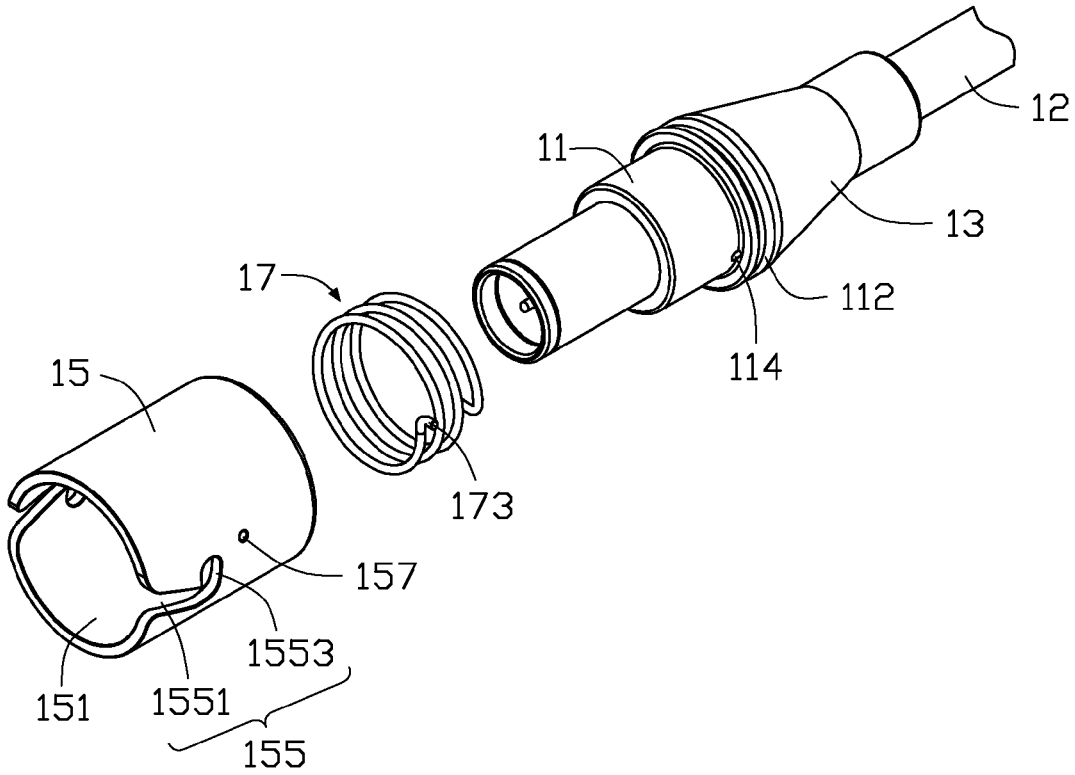
FIG. 3 is an exploded, isometric view of a plug of the connector of FIG. 2.

FIGS. 2-3 illustrate an embodiment of the plug 10 and the socket 30 of connector 100. The plug 10 can include a plug main body 11, a cable 12 coupled to the plug main body 11, a shielding member 13, a securing member 15, and a resilient member 17. The plug main body 11 can include a screw portion 112 that is configured to secure the securing member 15. A mounting hole 114, configured to engage with a first end 171 of the resilient member 17, is defined in the plug main body 11 and is adjacent to the screw portion 112. The shielding member 13 is coupled to the cable 12 and the plug main body 11. The securing member 15 is substantially a cylinder and defines a receiving hole 151 that is configured to receive the plug main body 11. An internal thread 153 is defined in a first end of the securing member 15, and two securing portions 155 are located on a second opposite end of the securing member 15. In at least one embodiment, each securing portion 155 can be a slot which includes a guiding portion 1551 and a positioning portion 1553 communicating with the guiding portion 1551. The positioning portion 1553 is slanted relative to the guiding portion 1551. A securing hole 157 is defined in the securing member 15 and is configured to secure a second end 173 of the resilient member 17.

The socket 30 can include an accommodating portion 31, a socket main body 33 located in the accommodating portion 31, and two clipping portions 35. The accommodating portion 31 can be defined in the electronic device 40 and is configured to receive the securing member 35. The socket main body 33 is configured to engage with the plug main body 11. Each clipping portion 35 is coupled to the accommodating portion 31 and the socket main body 33. The clipping portion 35 can be slid into the securing portion 155 via the guiding portion 155 and can be positioned in the positioning portion 1553.

FIGS. 1-3 illustrate an assembled view of the plug 10 of the connector 100. The plug 10 is received in the receiving hole 151. The first end 171 of the resilient member 17 is engaged in the mounting hole 114, and the second end 173 of the resilient member 17 is engaged in the securing hole 157. Thus, the resilient member 17 is secured to the securing member 15 and the plug main body 11. The internal thread 153 is engaged with the screw portion 112, thereby the securing member 15 is secured to the plug 11. Therefore, the plug 10 is assembled.

Figure 4:
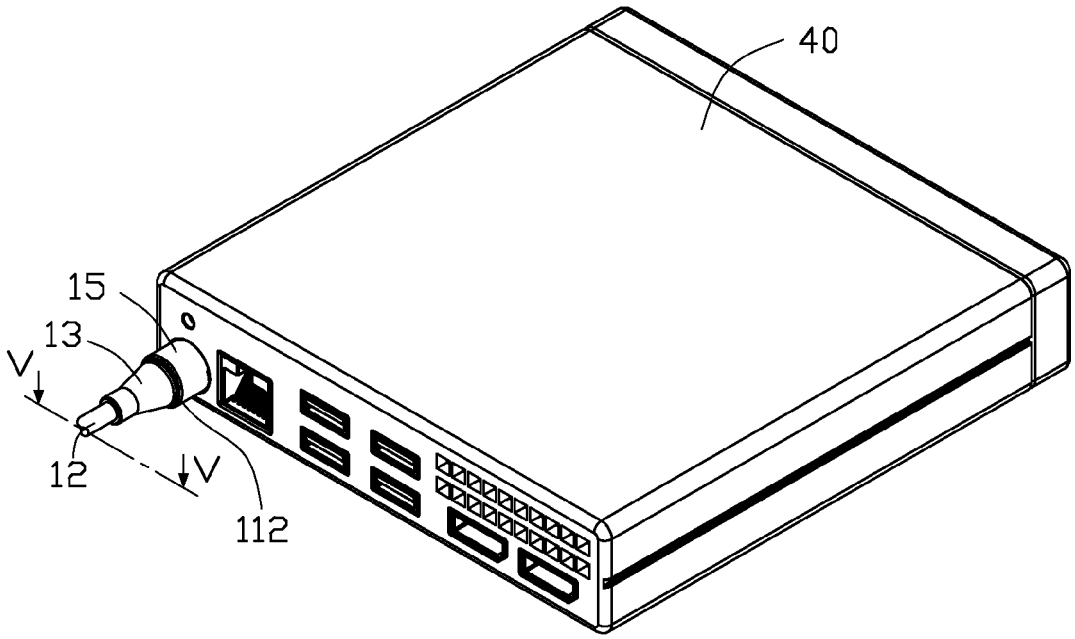
FIG. 4 is an assembled view of the connector and the electronic device of FIG. 2.
Figure 5:
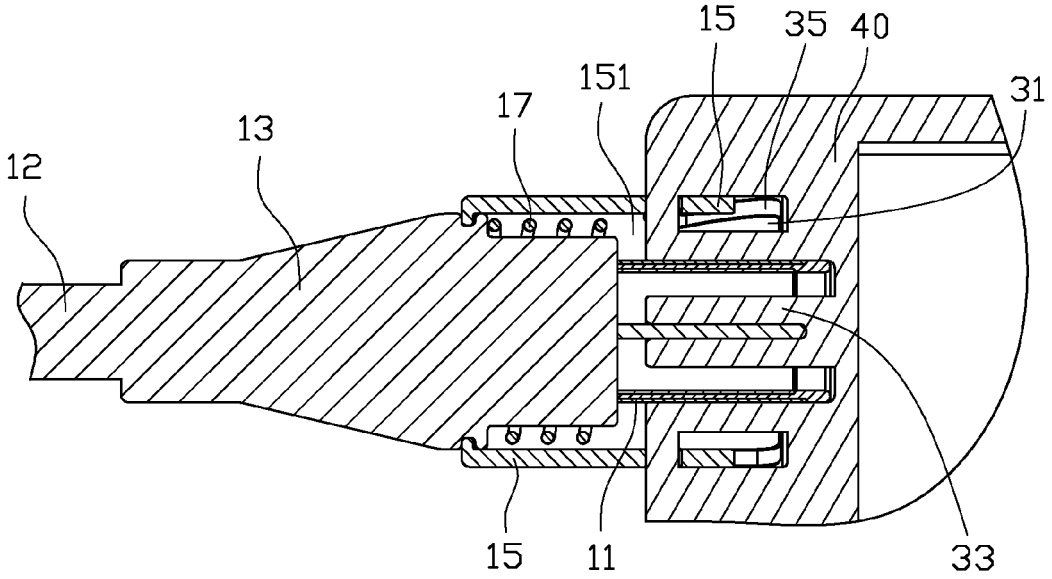
FIG. 5 is a cross-section view of FIG. 4, taken along a line V-V.

FIGS. 1, 4 and 5 illustrate that when the connector 100 needs to be used, the plug main body 11 is aligned with the socket main body 31, and the guiding portion 1551 of each securing portion 155 is aligned with each clipping portion 35. The plug 10 is moved towards the socket 30 for allowing the clipping portion 35 to slide into the guiding portion 1551 of each securing portion 155. The plug 10 is rotated relative to the socket 30 in a first direction for allowing the clipping portion 35 to extend through the guiding portion 1551 to clip in the positioning portion 1553. At this position, the plug 10 is engaged with the socket 30, and the resilient member 17 is deformed. The securing portion 155 can be clipped with the clipping portion 35 for preventing the plug main body 11 from disengaging from socket main body 31. Therefore, the plug 10 can be stably secured to the socket 30.

When the plug 10 needs to be disengaged from the socket 30, the plug 10 is rotated relative to the socket 30 in a second direction opposite to the first direction, and each clipping portion 35 can be disengaged from the positioning portion 1553. The plug 10 is moved to disengage from the socket 30 and is further rotated in the second direction, until the clipping portion 35 is removed from the guiding portion 1551 via the positioning portion 1553. Therefore, the plug 10 can be disengaged from the socket 30.

The embodiments shown and described above are only examples. Many details are often found in the art such as the other features of a plug and a connector. Therefore, many such details are neither shown nor described. Even though numerous characteristics and advantages of the present technology have been set forth in the foregoing description, together with details of the structure and function of the present disclosure, the disclosure is illustrative only, and changes can be made in the detail, especially in matters of shape, size and arrangement of the parts within the principles of the present disclosure up to, and including the full extent established by the broad general meaning of the terms used in the claims. It will therefore be appreciated that the embodiments described above can be modified within the scope of the claims.

What is claimed is:

1. A plug comprising:

a plug main body configured to engage with a socket;

a securing member rotatably attached to the plug main body and comprising a securing portion; and a resilient member with a first end secured to the plug main body and a second end secured to the securing member;

wherein when the plug is engaged with the socket, the securing member enables the securing portion to securely engage with the socket.

2. The plug of claim 1, wherein the securing portion is a slot and comprises a guiding portion and a positioning portion communicating with the guiding portion, and the positioning portion is slanted relative to the guiding portion.

3. The plug of claim 1, wherein the resilient member is located between the securing member and the plug main body, and the resilient member is deformable when the plug is engaged with the socket.

4. The plug of claim 1, wherein a mounting hole is defined in the plug main body, a securing hole is defined in the securing member, the first end of the resilient member is engaged in the mounting hole, and the second end of the resilient member is engaged in the securing hole.

5. The plug of claim 1, wherein the securing member is substantially a cylinder and defines a receiving hole, and the plug main body is received in the receiving hole.

6. The plug of claim 1, wherein the plug main body comprises a screw portion, and the securing member comprises an internal thread engaged with the screw portion.

7. The plug of claim 1, further comprising a cable and a shielding member, wherein the shielding member is secured to the plug main body and the cable.

8. A connector comprising:

a plug comprising a plug main body, a securing member rotatably attached to the plug main body, and a resilient member with a first end secured to the plug main body and a second end secured to the securing member; and a socket located on an electronic device and comprising a socket main body and a clipping portion coupled to the socket main body;

wherein when the plug is engaged with the socket, the securing member rotates relative to the socket to clip the securing member with the socket.

9. The connector of claim 8, wherein the securing member defines a slot which comprising a guiding portion and a positioning portion communicating with the guiding portion, and the positioning portion is slanted relative to the guiding portion.

10. The connector of claim 8, wherein the resilient member is located between the securing member and the plug main body, and the resilient member is deformable when the plug is engaged with the socket.

11. The connector of claim 8, wherein a mounting hole is defined in the plug main body, a securing hole is defined in the securing member, the first end of the resilient member is engaged in the mounting hole, and the second end of the resilient member is engaged in the securing hole.

12. The plug of claim 8, wherein the securing member is substantially a cylinder and defines a receiving hole, and the plug main body is received in the receiving hole.

13. The connector of claim 8, wherein the socket comprises an accommodating portion, the socket main body is located in the accommodating portion, and the clipping portion is coupled to the socket main body and an inner surface of the accommodating portion.

14. The connector of claim 8, wherein the plug main body comprises a screw portion, and the securing member comprises an internal thread engaged with the screw portion.

15. The connector of claim 8, wherein the plug further comprises a cable and a shielding member, and the shielding member is secured to the plug main body and the cable.

16. A connector comprising:

a plug comprising a plug main body and a securing member rotatably attached to the plug main body; and a socket located on an electronic device and comprising a socket main body and a clipping portion coupled to the socket main body;

wherein when the plug is engaged with the socket, the securing member rotates relative to the socket to clip the securing member with the socket; the socket further comprises an accommodating portion, the socket main body is located in the accommodating portion, and the clipping portion is coupled to the socket main body and an inner surface of the accommodating portion.

* * * * *